US012571599B2

(12) United States Patent
Cate et al.

(10) Patent No.: US 12,571,599 B2
(45) Date of Patent: Mar. 10, 2026

(54) HEAT EXCHANGE PANEL

(71) Applicant: ZEPHYROS, INC., Romeo, MI (US)

(72) Inventors: Peter Cate, Moisheim Cedex (FR); Dagmar van Heur, Munich (DE)

(73) Assignee: ZEPHYROS, INC., Romeo, MI (US)

( * ) Notice: Subject to any disclaimer, the term of this patent is extended or adjusted under 35 U.S.C. 154(b) by 0 days.

(21) Appl. No.: 18/563,685

(22) PCT Filed: May 19, 2022

(86) PCT No.: PCT/US2022/029960
§ 371 (c)(1),
(2) Date: Nov. 22, 2023

(87) PCT Pub. No.: WO2022/251024
PCT Pub. Date: Dec. 1, 2022

(65) Prior Publication Data

US 2024/0271884 A1 Aug. 15, 2024

Related U.S. Application Data

(60) Provisional application No. 63/192,785, filed on May 25, 2021.

(51) Int. Cl.
*F28F 3/14* (2006.01)
*F28F 19/02* (2006.01)

(52) U.S. Cl.
CPC ..... *F28F 3/14* (2013.01); *F28F 19/02* (2013.01); *F28F 2245/00* (2013.01); *F28F 2275/025* (2013.01)

(58) Field of Classification Search
None
See application file for complete search history.

(56) References Cited

U.S. PATENT DOCUMENTS 4,089,324 A * 5/1978 Tjaden ..... F28D 9/0062 428/184
5,836,383 A * 11/1998 Zwittig ..... F28F 3/12 165/DIG. 360
5,981,098 A * 11/1999 Vitale ..... H01M 8/0258 429/513

(Continued)

FOREIGN PATENT DOCUMENTS

CN 101657688 A * 2/2010 ..... F24F 3/147
DE 102005034997 A1 * 2/2007 ..... B23K 1/0012

(Continued)

OTHER PUBLICATIONS

DE-102012210091-A1 English machine translation (Year: 2013).*

(Continued)

*Primary Examiner* — Jenna M Maroney
(74) *Attorney, Agent, or Firm* — The Dobrusin Law Firm, P.C.; Daniela M. Thompson-Walters

(57) ABSTRACT

A heat exchange assembly comprising: (I) two or more panels; (II) a plurality of channels formed between the two or more panels; and (III) one or more reservoirs located adjacent to the plurality of channels and configured to at least temporarily store a temperature control material, wherein the plurality of channels are configured to direct a flow path of the temperature control material between the two or more panels and provide structural rigidity to the assembly.

19 Claims, 4 Drawing Sheets

(56) References Cited

U.S. PATENT DOCUMENTS

| | | | | |
|---|---|---|---|---|
| 6,273,183 | B1 * | 8/2001 | So | F28D 1/0333 165/152 |
| 6,846,559 | B2 | 1/2005 | Czaplicki | |
| 6,923,499 | B2 | 8/2005 | Wieber | |
| 7,125,461 | B2 | 10/2006 | Czaplicki | |
| 7,199,165 | B2 | 4/2007 | Kassa | |
| 7,521,093 | B2 | 4/2009 | Finerman | |
| 7,892,396 | B2 | 2/2011 | Sheasley | |
| 8,236,128 | B2 | 8/2012 | Kassa | |
| 8,334,055 | B2 | 12/2012 | Le Gall | |
| 8,475,694 | B2 | 7/2013 | Kassa | |
| 8,702,889 | B2 | 4/2014 | Sheasley | |
| 10,601,093 | B2 * | 3/2020 | Vanderwees | H01M 10/6557 |
| 11,407,330 | B2 * | 8/2022 | Cheadle | F28F 3/025 |
| 11,732,977 | B2 * | 8/2023 | Matsugi | F28D 9/02 165/168 |
| 12,135,173 | B2 * | 11/2024 | Minamitani | B32B 15/09 |
| 2010/0101563 | A1 * | 4/2010 | Fischer | F24S 10/55 126/651 |
| 2010/0175859 | A1 * | 7/2010 | Takada | F28D 9/0025 29/890.03 |
| 2013/0045411 | A1 * | 2/2013 | Bauer | F28F 3/025 429/120 |
| 2014/0090812 | A1 * | 4/2014 | Schmid | F28F 9/162 165/104.19 |
| 2015/0034287 | A1 * | 2/2015 | Otto | H01M 10/647 165/168 |
| 2015/0369545 | A1 * | 12/2015 | Naritomi | F28F 13/06 29/890.03 |
| 2016/0049705 | A1 * | 2/2016 | Mahe | F28F 3/10 29/890.03 |
| 2016/0204486 | A1 * | 7/2016 | Kenney | F28F 3/12 29/890.03 |
| 2019/0177926 | A1 * | 6/2019 | Theodore, Jr. | F24D 3/14 |
| 2019/0277578 | A1 * | 9/2019 | Bardeleben | F28F 3/025 |
| 2019/0366876 | A1 * | 12/2019 | Cheadle | F28D 1/035 |
| 2020/0003505 | A1 * | 1/2020 | Minamitani | F28F 21/062 |
| 2021/0199384 | A1 * | 7/2021 | Minamitani | F28D 9/0062 |

FOREIGN PATENT DOCUMENTS

| | | | | |
|---|---|---|---|---|
| DE | 102012210091 | A1 * | 12/2013 | H01M 10/615 |
| DE | 102013219570 | A1 * | 4/2014 | F28F 9/0221 |
| DE | 102014203102 | A1 * | 8/2015 | F28D 9/0012 |
| EP | 1748270 | A1 * | 1/2007 | B23K 1/0012 |
| EP | 3741876 | A1 * | 11/2020 | B23K 26/244 |
| EP | 3842726 | A1 * | 6/2021 | F28D 21/00 |
| JP | H06323774 | A1 * | 11/1994 | |
| JP | 2006132904 | A * | 5/2006 | F28F 3/025 |
| WO | WO-2008128235 | A1 * | 10/2008 | B23K 1/0014 |
| WO | WO-2011138246 | A1 * | 11/2011 | F28F 3/025 |
| WO | 2013/135866 | A1 | 9/2013 | |
| WO | 2021/022104 | A1 | 2/2021 | |

OTHER PUBLICATIONS

Corrosion Resistance-thyssenkrupp Dec. 2020 (Year: 2020).*
Polyester-Chemical Resistant-Engineering Toolbox Nov. 2020 (Year: 2020).*
JP H06323774 A English Machine Translation (Year: 1994).*
International Search Report and Written Opinion, Application No. PCT/US2022/029960, mailed Oct. 21, 2022.
EP Communication dated Dec. 20, 2024, Application No. 22729393.3.

* cited by examiner

HEAT EXCHANGE PANEL

CROSS-REFERENCE TO RELATED APPLICATIONS

This patent application claims the benefit and priority of U.S. Provisional Application No. 63/192,785, filed on May 25, 2021, all of which is hereby incorporated by reference herein in its entirety for all purposes.

FIELD

The present invention generally relates to a heat exchange assembly, and more particularly, to a multi-layered heat exchange assembly.

BACKGROUND

Electronic and power equipment are often required for various tasks throughout many industries. This electronic and power equipment often times generates high energy, excess heat, or both during continuous operation. For example, one particular industry is the automotive industry where many vehicles, such as electric vehicles, require rechargeable batteries to power the vehicles. However, these batteries often generate significantly high heat during operation which may in turn alter the performance of the batteries or even prevent the batteries from operating successfully. As a result, attempts have been made to provide cooling systems or heat exchange assemblies to maintain a desired temperature of the batteries near or slightly above room temperature.

One particularly common solution implemented in various vehicles is a heat exchange system in which a coolant flows through a housing in contact with a battery to draw the excess heat from the battery. The excess heat is then transferred through the coolant and expelled along an opposing surface of the heat exchange system not in contact with the battery. It is also possible that a refrigerant may be utilized in conjunction with an on-board air-conditioning circuit. These solutions allow the system to cool or heat the battery to the desired temperature as required. However, heat exchange systems often require structurally rigid metal materials to function properly. These metals often requiring excess manufacturing time, cost, or both. Additionally, the heat exchange systems often require a complicated internal core within a housing that directs or diverts the coolant during use. These internal cores are frequently complicated to manufacture, are heavy, are expensive, or a combination thereof. Furthermore, most existing heat exchangers are susceptible to impact damage and offer little benefit in terms of battery impact protection.

Examples of heat exchange systems can be found in International Application No. PCT/US2020/044383, all of which is incorporated by reference herein in its entirety for all purposes. There remains a need for a lightweight, cost-effective heat exchange assembly that can also protect the battery from external impact. What is needed is a heat exchange system having one or more metallic layers in combination with secondary components to direct coolant flow. There remains a need for a customizable heat exchange system. What is needed is a heat exchange assembly having a customizable and tunable channel pattern to direct a coolant temperature control material or other temperature control material. There remains a need for a heat exchange system that cools or heats one or more components while also providing structural rigidity and impact protection.

What is needed is a heat exchange assembly that also provides structural reinforcement.

SUMMARY

The present teachings meet one or more of the present needs by providing a heat exchange assembly comprising: (I) two or more panels; (II) a plurality of channels formed between the two or more panels; and (III) one or more reservoirs connected to or located adjacent to the plurality of channels and configured to at least temporarily store a temperature control material, wherein the plurality of channels are configured to direct a flow path of the temperature control material between the two or more panels.

The present teachings meet one or more of the present needs by providing a heat exchange assembly comprising: a metallic or polymeric core disposed between the two or more panels, wherein a plurality of projections, domes or other geometries form the plurality of channels; an adhesive or other joining material disposed between the two or more panels that forms the plurality of channels as well as providing a structural joint between the layers; a plurality of side walls that abut terminal edges of the two or more panels to form a housing around the plurality of channels; a second reservoir, wherein the reservoirs are positioned on opposing ends of the plurality of channels so that the temperature control material flows between the reservoirs through the plurality of channels; or a combination thereof.

A first panel may be metallic and a second panel may be metallic or polymeric. The reservoir may include an opening that abuts the plurality of channels so that the flow path of the temperature control material moves from the reservoir, through the opening, and into the plurality of channels, or vice versa. The flow path of the temperature control material may loop through the plurality of channels in a snake-like pattern. The flow path of the temperature control material may flow through the plurality of channels in a substantially parallel and simultaneous manner. The flow path of the temperature control material may be substantially random. The adhesive may be a foamable or non-foamable material applied in a desirable pattern for one or more of joining the panels and directing coolant. The two or more panels may be spaced apart by a thickness of the adhesive after assembly and foaming (if a foamable material is used). The two or more panels may be spaced apart by a thickness of the adhesive after assembly, even if a foamable material is not utilized. The two or more panels may include a coating to protect from galvanic or other types of corrosion. The two or more panels may include a top panel, a bottom panel, and an intermediate panel. The plurality of channels may be disposed between both the top panel and intermediate panel, and the intermediate panel and the bottom panel. The temperature control material may be polyethylene glycol, air, refrigerant, water, alcohol, phase change material or a combination of these. The core may be a formed aluminum or other metal. At least one of the two or more panels may be permeable. One or more reservoirs may be positioned on opposing ends of the plurality of channels so that the temperature control material flows between the reservoirs through the plurality of channels. The plurality of channels may be formed via a plurality of projections extending between the two or more panels. The adhesive may remain structurally intact between −40° C. and at least 80° C. The heat exchange assembly may be incorporated into an automotive battery housing. The two or more panels may be spaced apart via one or more spacers to create a desired gap between the two or more panels. The opening of the reservoir may include one or more reinforcement struts that maintain a structure of the opening.

The assembly may include a heating element. The plurality of channels may include a heating element. The assembly may include a heating element and the heating element comprises one or more resistive wires. The assembly may include an induction heating component. The assembly may be substantially free of any adhesive material.

The heat exchange assembly may include a plurality of channels interconnected by one or more bridges to form a core. At least a portion of the bridges may include a valley. An adhesive material may be disposed within the valleys to secure the core to the two or more panels. The valleys may form a cavity with the two or more panels. The adhesive material may be positioned within the cavity after assembly to prevent contact between the adhesive material and the temperature control material.

The present teachings meet one or more of the present needs by providing a lightweight, structural and impact resistant heat exchange assembly; a heat exchange system having one or more metallic and/or polymeric layers; a customizable heat exchange system; a heat exchange assembly having a customizable and tunable channel pattern to direct a coolant temperature control material; a need for a heat exchange system that cools or heats one or more components while also providing structural rigidity; a heat exchange assembly that provides structural reinforcement; or a combination thereof.

DETAILED DESCRIPTION

Figure 1:
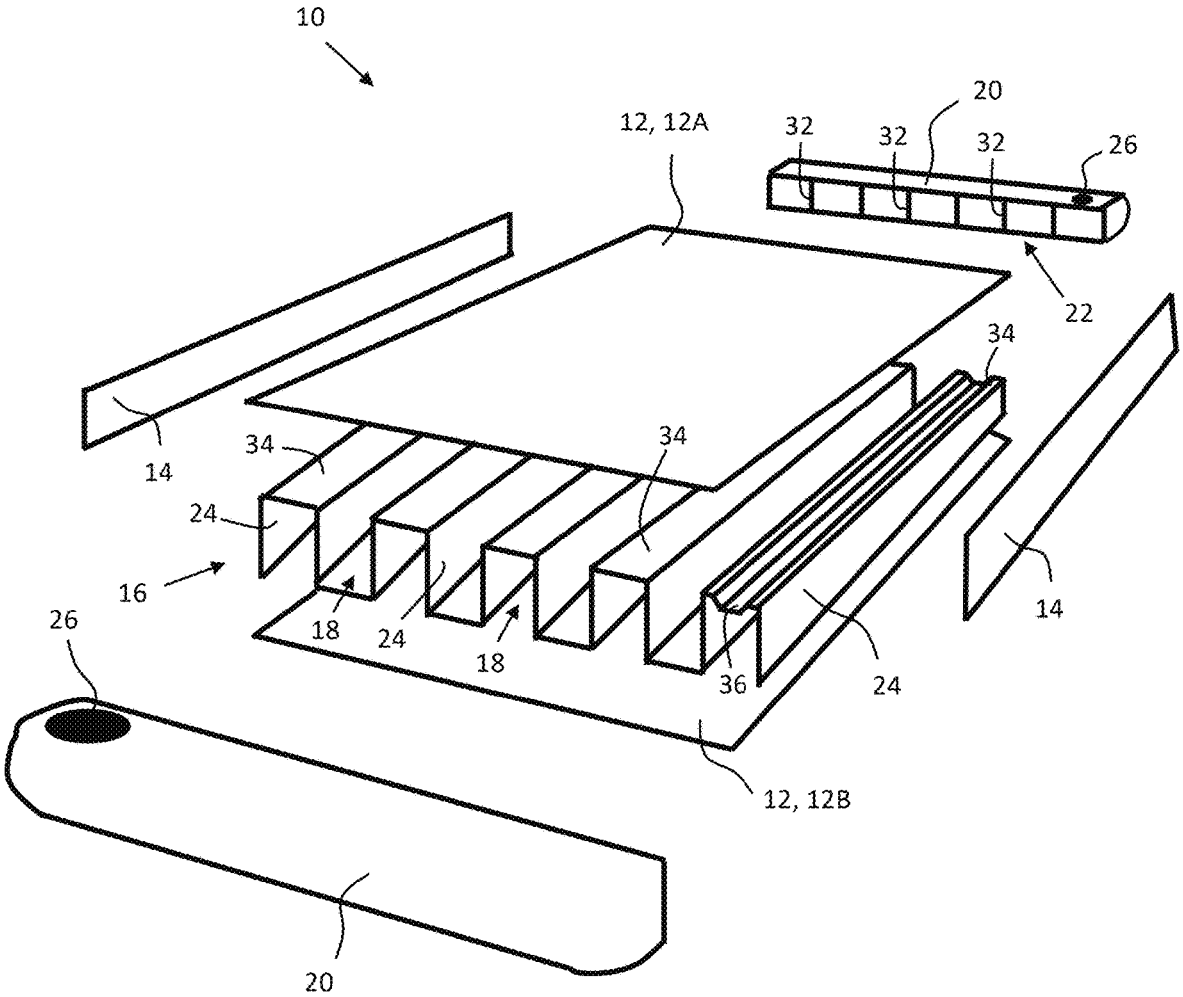
FIG. 1 is an exploded perspective view of a panel assembly.

The explanations and illustrations presented herein are intended to acquaint others skilled in the art with the invention, its principles, and its practical application. The specific embodiments of the present invention as set forth are not intended as being exhaustive or limiting of the invention. The scope of the invention should be determined with reference to the appended claims, along with the full scope of equivalents to which such claims are entitled. The disclosures of all articles and references, including patent applications and publications, are incorporated by reference herein in their entirety for all purposes. Other combinations are also possible as will be gleaned from the following claims, which are also hereby incorporated by reference in their entirety into this written description.

The teachings herein are directed toward a heat exchange assembly. The heat exchange assembly may function to decrease or increase a temperature of one or more components by transferring heat from the one or more components through the heat exchange assembly. The heat exchange assembly may abut one or more surfaces of a component being cooled or heated. The heat exchange assembly may support the component being cooled or heated. For example, the heat exchange assembly may be integrated into a battery housing that supports or encloses a battery of a vehicle. The heat exchange assembly may include one or more layers, one or more coolants, one or more housings, or a combination thereof. The heat exchange assembly may include one or more circulating temperature control materials. The temperature control materials may circulate through the heat exchange assembly via one or more pumps, one or more motors, one or more impellers, one or more propellers, or a combination thereof. The heat exchange assembly may be corrosion resistant. The heat exchange assembly may be moisture resistant. The heat exchange assembly may include one or more baffling materials. The one or more baffling materials may decrease noise of the heat exchange assembly, absorb noise of the heat exchange assembly, or both. The heat exchange assembly may be isotropic such that the heat exchange assembly is substantially uniform in different directions. Conversely, the heat exchange assembly may be anisotropic such that the heat exchange assembly has different mechanical and/or material properties when measured in opposing directions. For example, the heat exchange assembly may be structurally rigid along a longitudinal axis yet be flexible along an axis transverse to the longitudinal axis.

The heat exchange assembly may include two or more panels. The panels may function to form an outer shell of the heat exchange assembly. The panels may function to form a housing around an inner portion of the heat exchange assembly. The panels may support the component being cooled or heated. The panels may be an initial point of contact between the component and the heat exchange assembly to transfer heat to or from the component to the heat exchange assembly. For example, a top panel of the heat exchange assembly may support and abut a bottom portion of a battery so that heat is initially transferred from the battery to the top panel or vice versa. The panels may preferably be structurally rigid. The panels may be flexible. The panels may be moisture resistant, corrosion resistant, anti-microbial, anti-fungal, or a combination thereof. For example, the panels may include one or more coatings to protect from galvanic or other types of corrosion. The panels may be permeable. The panels may include one or more holes, gaps, spaces, or a combination thereof to form a permeable layer. The panels may be substantially moisture resistant or airtight to prevent leakage of a coolant temperature control material flowing through an interior of the heat exchange assembly.

The panels may be any desired shape and material. The panels may have any desired thickness. The panels may have a thickness of less than 1 mm, about 1 mm or more, about 2 mm or more or about 3 mm or more. The panels may have a thickness of about 6 mm or less, about 5 mm or less, or about 4 mm or less. The panels may be metallic. For example, the panels may be aluminum, iron, steel, copper, bronze, or a combination thereof. Alternatively, the panels may be polymeric. For example, the panels may be a polyamide material reinforced with glass fibers. The panels may be the same material or may have different materials. For example, a top and bottom panel may be metallic while one or more intermediate panels are a polyamide material. The panels may include one or bends, one or more arcuate portions, one or more linear segments, one or more curves, one or more projections, one or more cutouts, one or more notches, one or more fillets, one or more holes, or a combination thereof. The panels may be substantially planar. For example, the panels may be substantially sheet-like panels.

The panels may be positioned anywhere relative to each other. The panels may be spaced apart from one another to form a desired gap between the panels. The gap may be selected based on an inner portion of the heat exchange assembly. For example, the gap between panels may form a cavity that is filled with one or more adhesives, one or more cores, or both. The panels may be positioned substantially coplanar to one another. For example, the panels may be joined along peripheral edges to form the overall dimensions of the heat exchange assembly. The panels may be positioned substantially parallel to each other, perpendicular to each other, or both. The panels may be a single panel. The panels may be a plurality of panels. The heat exchange assembly may include about one or more panels, about two or more panels, or about three or more panels. The heat exchange assembly may include about six or less panels, about five or less panels, or about four or less panels. The panels may form one or more inner cavities of the heat exchange assembly. The one or more inner cavities may include one or more inner portions of the heat exchange assembly.

The panels may be spaced apart by one or more spacers. The spacers may function to maintain a desired gap between panels. The spacers may abut surfaces of one or more panels. The spacers may be compressible. The spacers may be structurally rigid. The spacers may be any size and shape. The spacers may have any desired length to form a desired gap. For example, the spacers may have a thickness of less than 1 mm, about 1 mm or more, about 2 mm or more, or about 3 mm or more. The spacers may have a thickness of about 6 mm or less, about 5 mm or less, or about 4 mm or less. The spacers may be adhered to the panels. The spacers may be fixed to the panels using one or more fasteners. The spacers may be removable. The heat exchange assembly may include a plurality of spacers. The heat exchange assembly may be free of spacers. For example, a desired gap between panels may be maintained free of the spacers.

The panels may be connected to one or more side walls. The side walls may function to protect an inner portion of the heat exchange assembly. The side walls may abut peripheral edges of the panels. The side walls may be positioned within the gap between the panels. The side walls may form a desired height of the heat exchange panel. The side walls in conjunction with the panels may form an overall housing of the heat exchange assembly. The side walls may abut the component being cooled or heated. The side walls may be an initial point of contact between the heat exchange assembly and the component being cooled or heated. The side walls may be secured to the panels. The connection may be formed via one or more mechanical fasteners, one or more adhesives, one or more sealants or more than one of these. For example, the connection may be formed using one or more bolts, welding, or both. The side walls may be integrally formed with one or more of the panels. The side walls may have any desired size or shape. The side walls may be shaped substantially similar to the panels or may be different. The side walls may have a length substantially equal to a length of the panels. The side walls may form a sealed housing with the panels. For example, the side walls and the panels may create a hermetically sealed housing, a waterproof housing, a leakproof housing, or a combination thereof. The side walls may abut sides of a core.

The core may function to form an inner member of the heat exchange assembly. The core may function to divert, direct, or both a flow path of a temperature control material of the heat exchange assembly. The core may be positioned between the panels, side walls, or both. The core may be positioned within an inner cavity of the heat exchange assembly. The core may provide structural reinforcement to the heat exchange assembly. The core may be structurally rigid or may be flexible. The core may have a shape similar to the panels, side walls, or both. For example, the core and the panels, side walls, or both may be coextensive with one another. The core may be positioned between the panels to form a desired gap between the panels when the panels abut opposing surfaces of the core. The core may be a single, monolithically formed structure. Alternatively, the core may include one or more interconnected segments. The core may form a path for a coolant temperature control material. For example, the core may include one or more projections, one or more ribs, one or more channels, one or more cavities, one or more walls, one or more projections, one or more ribs, one or more recesses, or a combination thereof to direct temperature control material, deflect temperature control material, or both. The core may include one or more bends, one or more arcuate portions, one or more linear segments, one or more crossmembers, or a combination thereof. The core may be integrally (i.e., monolithically) formed with one or more of the panels. For example, the panels may include a plurality of projections or a plurality of ribs that, when joined to an opposing panel, form a plurality of channels in between the panels that may represent the core. Alternatively, the core may be a separate piece joined to the one or more panels during an assembly process. The core may be joined to the panels via one or more fasteners, one or more adhesives, one or more sealants or more than one of these.

The core may be any desired material. The core may be metallic, polymeric, or both. The core may be a corrugated material. The core may be extruded, pultruded, molded, stamped, embossed, cast or a combination thereof. The core may be roll-formed or otherwise milled. The core may include one or more interconnected or bonded components. Alternatively, the core may be monolithically (i.e., integrally) formed from a single piece of material. The core may include one or more coatings. The one or more coatings may protect the core from corrosion, degradation, or both. The coatings may also aid adhesion, sealing, or both. The core may be permeable.

The core may include a plurality of projections. The projections may function to create an overall shape of the core. The projections may function to provide structural integrity to the heat exchange assembly. The projections may function to join the core to the panels, side walls, or both. The projections may function to divert and direct a flow path of the coolant temperature control material. The projections may be interconnected or spaced apart. The projections may extend along a longitudinal axis of the core. The projections may extend substantially parallel to the longitudinal axis of the core. The projections may extend at any angle relative to the longitudinal axis of the core. For example, the projections may extend substantially transverse to a length of the core. The projections may create one or more spines extending along a length, a width, or both of the core. For example, the core may include a plurality of substantially uniform projections extending substantially parallel to one another along a length of the core. The projections may have a desired height. The projections may have a height of about 1 mm or more, about 2 mm or more, or about 3 mm or more. The projections may have a height of about 6 mm or less, about 5 mm or less, or about 4 mm or less. The projections may have a length substantially equal to or less than a length of the core. The projections may have a length substantially equal to or less than a width of the core. The projections may be monolithically formed with the core. The projections may be inserted into the core. For example, one or more rods may be inserted into the core.

The projections may be interconnected by one or more bridges. The bridges may function to provide further structural integrity to the projections. The bridges may function to interconnect the projections to form a spine, a channel, or both. The bridges may extend substantially perpendicular to the projections, one or more panels, or both. The bridges may define a width between connected projections. The bridges may extend at an angle other than substantially perpendicular to the projections. The bridges may be substantially planar, flat, or both. Additionally, the bridges may include a contour to create a non-planar surface.

The bridges may include a valley. The valley may be a contoured portion of the bridges that extends above or below a height of the projections. As such, the valley may function to increase structural integrity of the overall core. The valley may be a channel, divot, dimple, dot, point, passageway, groove, trench, or a combination thereof. The valley may include a longitudinal distance along the bridge, a latitudinal distance (i.e., a width) along the bridge, or both. Similarly, the valley may be one or more localized dips or undulations, depressions, or both within the bridges. The valley may be any desired geometry to optimize construction and/or performance of the heat exchange assembly. The valley may be continuous or discontinuous. The valleys may be substantially linear, may include one or more contours, may include one or more bends, or a combination thereof. The bridges may abut one or more panels disposed along the core so that the valley may form a cavity with the panel. That is, terminal ends of the projections connected by the bridges may abut the panel so that the panel extends along a width between the projections yet is substantially free of contact with the valley. As a result of such a configuration, the cavities formed between the panels and the valley may be substantially free of contact with a temperature control material passing through the core. Therefore, the cavity may form a moisture-protected region within the core.

An adhesive material or other connecting means may be used in lieu of, or in conjunction with, the core. The adhesive material may function to secure the panels to one another. The panels may be welded or brazed together. The adhesive material or other connecting means may function to create an inner portion between the panels that receives a coolant temperature control material. The adhesive material may create a desired gap between the panels. The adhesive material may form a path for the coolant temperature control material. The adhesive material may be disposed on one or more surfaces of one or more panels. The adhesive material may create one or more voids, one or more cavities, or both between panels. The adhesive material may join the panels, side walls, or both together to form a housing of the heat exchange assembly. For example, the adhesive material may be disposed on a mating surface of a top panel that abuts a mating surface of a bottom panel. The adhesive material may reinforce the heat exchange assembly. The adhesive material may baffle noise of the heat exchange assembly.

The adhesive material may be disposed on one or more panels to create any desired shape. The adhesive material may be disposed using one or more extrusion methods, such as a robotic applicator. The adhesive material may be disposed in a substantially uniform pattern. The adhesive material may be disposed in a substantially nonuniform pattern. The adhesive material may form one or more pathways for a coolant temperature control material. The adhesive material may be disposed along any portion of the panels. The adhesive material may be disposed along a portion or all of one or more panels. For example, the adhesive material may be disposed along substantially all of one or more panels and the adhesive material may be permeable so that a coolant temperature control material may flow through the adhesive material. Therefore, the adhesive material may form a pattern to direct a temperature control material, deflect a temperature control material, or both, and be used in lieu of the core. Alternatively, the adhesive material may form a portion of a flow path of the temperature control material in conjunction with the core.

The adhesive material may secure the core to one or more panels, side walls, or both. The adhesive material may be disposed along one or more surfaces of the panels, side walls, core, or a combination thereof. The one or more surfaces may be located along the projections, bridges, ribs, spines, or a combination thereof of the core. The adhesive material may be disposed along the valleys of the bridges.

Advantageously, the adhesive material may be positioned within the valleys formed in the bridges of the core. Thus, the valleys may function to control a position of the adhesive during dispensing of adhesive onto the core. Similarly, the valleys may function to control an adhesive bond thickness as dictated by a depth of the valleys, a width of the valleys, or both.

As a result, the adhesive material may be sandwiched between the bridge and a panel to join the panel to core. The valley may therefore contain the adhesive material during assembly to prevent squeeze out of the adhesive material into adjacent channels containing the temperature control material. Due to the adhesive material being located within the valley, once the panel abuts the core, the adhesive material may be positioned in a cavity formed between the valley and the panel. Beneficially, the adhesive material may then be substantially protected from a temperature control material flowing through the core. That is, the cavity formed within the core may be protected from direct contact with the temperature control material, thereby protecting the adhesive material from degradation. Thus, the adhesive material may prolong its performance, thereby prolonging the performance of the heat exchange assembly.

The valleys may also advantageously decrease an overall thickness of the heat exchange assembly. If the adhesive material is disposed within the valleys, the adhesive material may no longer need to be positioned between adjacent flat surfaces of the panels and the core. That is, a thickness of the adhesive material (e.g., a bond thickness) may be at least partially contained within the valley. As a result, at least a portion of the adhesive material thickness may no longer increase the thickness of the heat exchange assembly due to its containment within the valley.

The adhesive material disposed within the valleys may be any desired thickness. The adhesive material may have a thickness (e.g., a bond thickness) of about 0.1 mm or more, about 0.3 mm or more, or about 0.5 mm or more. The adhesive material may have a thickness (e.g., a bond thickness) of about 2 mm or less, about 1.5 mm or less, or about 1 mm or less. As such, it is envisioned that all or a portion of the adhesive material is contained within the valley. For example, one or more panels bonded to the core may directly abut the bridge to substantially eliminate a joint gap between the panel and the core. However, if a joint gap between the panel and the core may exist, it is contemplated that the joint gap may be substantially minimized by providing a valley having a depth substantially equal to or near a thickness of the adhesive material. As a result, the adhesive material may have a significantly decreased surface area for exposure to a temperature control material penetrating through any joint gap.

The adhesive material may be any adhesive material that is compatible with a coolant/refrigerant composition. The adhesive material may be expandable upon activation. The adhesive material may be heat activated, activated by an activating agent, or both. The adhesive material may be foamable. The adhesive material may be thermoactivated. The adhesive material may be curable. The adhesive material may be cured at a heightened temperature during a manufacturing process. Alternatively, the adhesive material may be cured at room temperature and not require a heightened temperature to cure. The adhesive may have a desired open time of up to one day. The adhesive may have a desired curing time. The curing time may be about 30 seconds or more, about 1 minute or more, or about 5 minutes or more. The curing time may be about 20 minutes or less, about 15 minutes or less, or about 10 minutes or less. The adhesive material may be dry to the touch or tacky prior to activation. The adhesive material may be room temperature stable. The adhesive material may include an adhesive polymeric material (e.g., epoxy resin or the like). The adhesive material may include one or more of the following: an epoxy resin; a flexibilizer; a phenoxy resin; an impact modifier; a blowing agent; a curing agent; a filler; or a combination thereof. If the adhesive material is expandable or foamable, the adhesive material may expand to a volume greater than its volume in the unexpanded state (e.g., at least 5% greater, at least 20% greater, or even possibly at least 50% greater). The volumetric expansion may be about 400% or less, about 300% or less, or about 200% or less relative to the original unexpanded volume. The volumetric expansion may be about 50% or more, about 100% or more, or about 150% or more relative to the original unexpanded volume. Alternatively, the volume of the adhesive material may be less after activation due to curing (e.g., cross-linking) for foamed and/or unfoamed versions of the adhesive material. A plurality of adhesive materials may be disposed on one or more surfaces of the panels, side walls, core or more than one of these. Examples of adhesive materials may be found in U.S. Pat. Nos. 6,846,559; 6,923,499; 7,125,461; 7,199,165; 7,521,093; 7,892,396; 8,236,128; 8,334,055; 8,475,694; and 8,702,889, all of which are incorporated by reference herein in their entirety for all purposes.

The assembly may be substantially free of any adhesive material. The adhesive material may form a plurality of projections. The projections may function to divert a flow path of the coolant temperature control material. The projections may extend between opposing panels. The projections may be any size and shape. The projections may be structurally rigid. The projections may be tapered. The projections may have any cross-sectional shape. The projections may extend from the panels, side panels, or both at any desired angle.

The projections, the adhesive material, or both may form a plurality of channels. The channels may function to receive and direct a coolant temperature control material of the heat exchange assembly. The channels may function to create a flow path of the coolant temperature control material. The channels may be formed between the projections of the channel. The channels may extend substantially parallel to each other. The channels may extend substantially perpendicular to each other. The channels may extend at any angle relative to each other. The channels may be interconnected. The channels may intersect. The channels may be interconnected to form an overall temperature control material path. Alternatively, the channels may form a plurality of temperature control material paths so that the temperature control material may travel through a plurality of temperature control material paths substantially simultaneously.

The channels may be any size and shape. The channels may be U-shaped, V-shape, C-shaped, D-shaped, circular, square, rectangular, triangular, or a combination thereof. The channels may have any desired cross-sectional dimensions. For example, a width of the cross-section of the channels may be substantially equal to a gap between the panels. The channels may include one or more bends, one or more arcuate portions, one or more linear segments, or a combination thereof. The channels may include one or more openings, one or more holes, or both. For example, the channels may include one or more openings located near opposing ends of the channels. The channels may be substantially enclosed. The channels may be partially open.

The channels may be fluidly connected to one or more reservoirs. The reservoirs may function to at least temporarily store a coolant temperature control material. The reservoirs may be in fluid communication with the channels formed by the adhesive, the core, or both so that a coolant temperature control material may flow from the reservoir through the channels, or vice versa. The reservoirs may be positioned near opposing ends of the channels. The reservoirs may be secured to the panels, side walls, core, adhesive material, sealant, or a combination thereof. The reservoirs may be any size and shape. The reservoirs may be leak-proof (e.g., hermetically sealed). The reservoirs may have a holding capacity sufficient to maintain a desired temperature control material level throughout the heat exchange assembly.

A plurality of reservoirs may be in communication with one another. The reservoirs may be connected directly or indirectly to one another. For example, the reservoirs may be indirectly connected to one another via the channels so that a coolant temperature control material may flow from a first reservoir through the channels and into a second reservoir. As such, the coolant temperature control material may then be recirculated via a pump, impeller, propeller, turbine, or a combination thereof to create a closed-loop system. Alternatively, the reservoirs may aid in creating an open-loop system free of recirculation of the coolant temperature control material.

The reservoirs may include one or more holes. The holes may function as an inlet for the coolant temperature control material, an outlet for the coolant temperature control material, or both. The holes may be positioned anywhere along the reservoirs. The holes may be any size and shape. The holes may allow a temperature control material to enter, exit, or both from a cavity within the reservoir. The holes may include a cover, lid, plug, or a combination thereof to prevent unwanted spilling of the coolant temperature control material while in use. The cover, lid, plug, or a combination thereof may be removable to fill the reservoirs. The holes may connect one or more tubes to the heat exchange assembly to create the open-loop system, closed-loop system, or both.

The reservoirs may include an opening. The opening may function to create the temperature control material communication between the reservoirs and an inner portion of the heat exchange assembly. For example, the coolant temperature control material may flow from the reservoir, through the opening, and into one or more channels of the heat exchange assembly. The opening may be any desired size and shape. The opening may be tapered or may maintain a uniform size. The opening may connect to the heat exchange assembly. For example, the opening may be received by a female portion of the heat exchange assembly. Alternatively, the reservoirs may be secured to the heat exchange assembly via one or more fasteners, one or more adhesives, or both so that the opening abuts the inner portion of the heat exchange assembly. The abutment between the inner portion of the heat exchange assembly and the opening may be free of voids and gaps to prevent leakage or unwanted discharge of the coolant temperature control material.

The opening may include one or more struts. The struts may function to structurally reinforce the opening. The struts may be structurally rigid. The struts may be positioned anywhere along the opening. The struts may extend between opposing walls of the opening. The struts may be any size and shape. The struts may be spaced apart a desired length. The structs may extend into the reservoir. The struts may align with one or more channels of the heat exchange panel. The struts may deflect the coolant temperature control material to decrease a flow rate of the coolant temperature control material entering the inner portion of the heat exchange assembly. The struts may be removable. The struts may be adjustable. The struts may be secured to the heat exchange assembly.

The heat exchange temperature control material may flow through the heat exchange assembly. The temperature control material may maintain a temperature of one or more components being cooled, a temperature of the heat exchange assembly, or both. The temperature control material may be any desired temperature control material. The temperature control material may be a liquid, gas, or both. The temperature control material may be air. The temperature control material may be water, alcohol, or both. The temperature control material may be a glycol mixture. For example, the temperature control material may be a polyethylene glycol. The temperature control material may be a low-silicate temperature control material. The temperature control material may be a refrigerant. For example, the temperature control material may be a fluorocarbon, especially chlorofluorocarbons, ammonia, sulfur dioxide, and non-halogenated hydrocarbons such as propane. The temperature control material may be a phase change material such that it does not flow but instead melts or solidifies at desired temperature range (most desirably ~25-30° C. for batteries). Upon melting, the phase change material may absorb heat from the battery. Then at lower temperatures the phase change material may re-solidify, helping to insulate the battery from cold. The temperature control material may be a lubricant or fluid configured specifically for electric vehicles, such as those lubricants or fluids configured to reduce the lifecycle emissions of electric vehicles while increasing efficiency of the electric vehicles and a lifespan of the electric vehicles, the temperature control material, or both. The temperature may be controlled by one or more heating elements located within one or more of the channel or reservoir or associated with assemble in some other way. The heating element may comprise one or more electrically resistive wires. The heating element may heat via an induction heating system.

The temperature control material may be propelled through the heat exchange assembly via one or more impellers, one or more propellers, one or more pumps, or a combination thereof. The temperature control material may have any desired flow rate, pressure, or both. The temperature control material may be in a closed-looped system, open-looped system, or both. The temperature control material may be recirculated. The temperature control material may be filtered during a recirculation process.

Turning now to the figures, FIG. 1 illustrates a perspective view of a heat exchange assembly 10. The heat exchange assembly 10 includes a plurality of panels 12 encasing a core 16. A top panel 12A and a bottom panel 12B are positioned on opposing surfaces of the core 16. Additionally, opposing side walls 14 abut sides of the core 16 so that the side walls 14 and the panels 12 form a housing for the core 16. The core 16 includes a plurality of projections 24 which may be ribs extending substantially along, or parallel to, a longitudinal axis of the core 16. The plurality of projections 24 may be interconnected by one or more bridges 34 to form a plurality of channels 18. The channels 18 may receive and direct a flow path of a temperature control material, such as a coolant material (see FIGS. 3 and 4). It is envisioned that the temperature control material may be substantially contained within the channels 18. To secure the panels 12 to the core 16, the heat exchange assembly 10 may include an adhesive material disposed on the core 16, the panels 12, or both (not shown). For example, an adhesive material may be positioned within a valley 36 of the bridges 34 to secure the panel 12 to the core 16. It should be noted that all or a portion of the bridges 34 may include a valley 36. That is, a portion of the bridges 34 may include a valley 36, a portion of the bridges 34 may be substantially planar, or both.

The heat exchange assembly 10 further includes opposing reservoirs 20 each having a hole 26 to receive the temperature control material, expel the temperature control material, or both. The reservoirs 20 each include an opening 22 having a plurality of reinforcing struts 32 that abut opposing ends of the core 16 so that the temperature control material may flow between the reservoirs 20 through the core 16.

Figure 2:
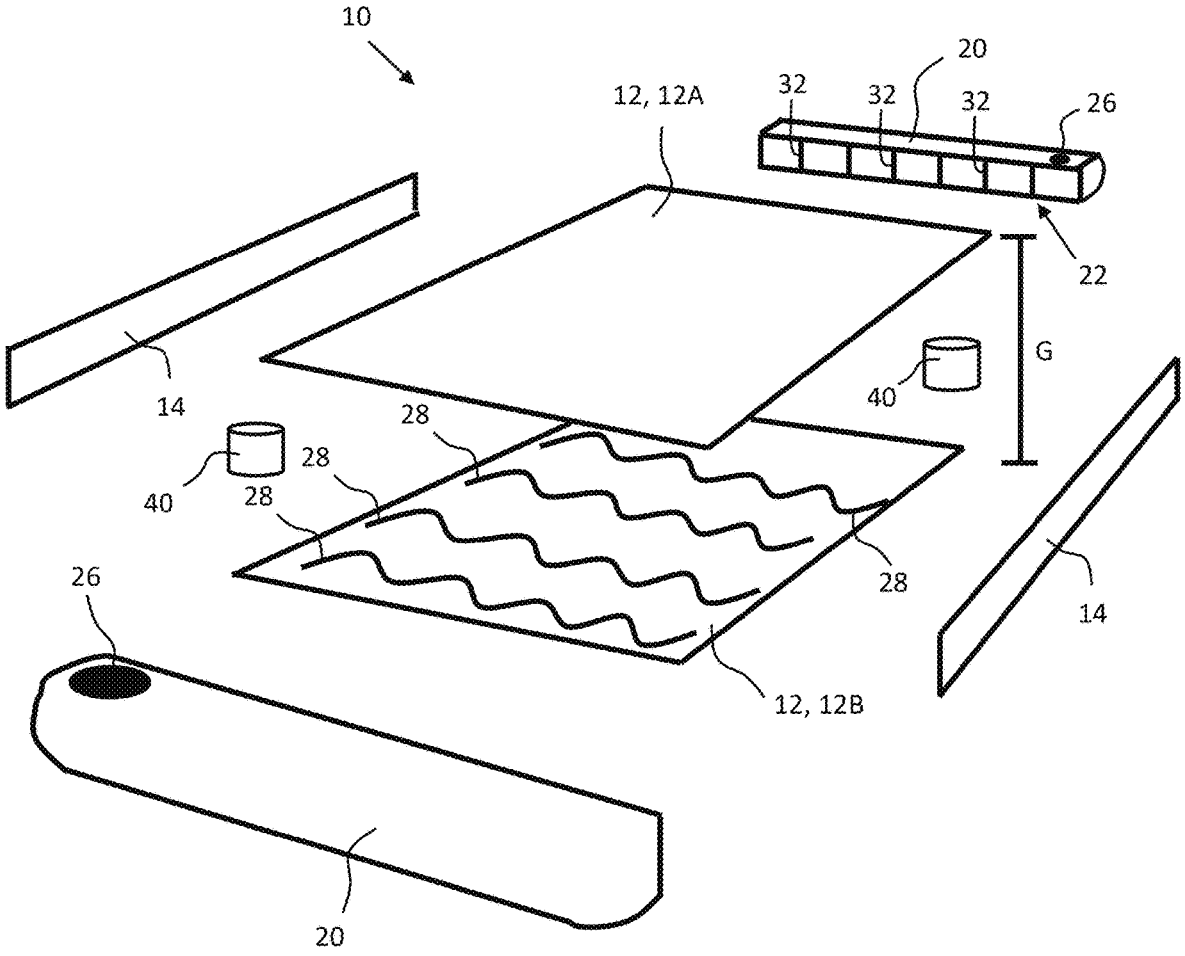
FIG. 2 is an exploded perspective view of a panel assembly free of a core.

FIG. 2 illustrates a perspective view of a heat exchange assembly 10. The heat exchange assembly 10 includes a plurality of panels 12. A top panel 12A, a bottom panel 12B, or both may include an adhesive material 28 disposed on one or more surfaces. The adhesive material 28 may be configured to form a certain shape, path, pattern, or a combination thereof to direct a flow path of a temperature control material. For example, the adhesive material 28 may form a plurality of channels that direct the flow path of the temperature control material (see FIGS. 3 and 4). The adhesive material 28 may have a desired thickness so that, when the top panel 12A and the bottom panel 12B abut the adhesive material 28, a desired gap (G) is created between the panels 12 that substantially correlates to a thickness (i.e., a height) of the adhesive material 28. The gap (G) may be maintained via one or more spacers 40 disposed between the panels 12. The adhesive material 28 may be applied to the panels 12 having a desired height, may be cured to expand to a desired height, or both. Additionally, opposing side walls 14 abut edges of the panels 12 within the gap (G) so that the side walls 16 and the panels 12 form a housing around the adhesive material 28. The exchange assembly 10 further includes opposing reservoirs 20 each having a hole 26 to receive the temperature control material, expel the temperature control material, or both. The reservoirs 20 each include an opening 22 having a plurality of reinforcing struts 32 that abut opposing ends of the panels 12 so that the temperature control material may flow between the reservoirs 20 and through the pattern created by the adhesive material 28.

Figure 3A:
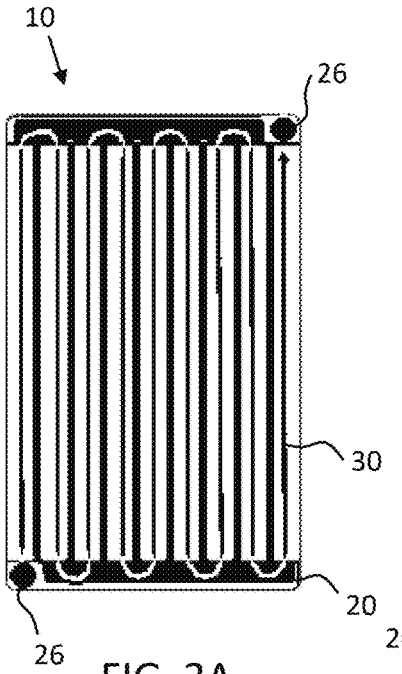
FIG. 3A is a top view of a panel assembly illustrating a loop flow path of a temperature control material.
Figure 3B:
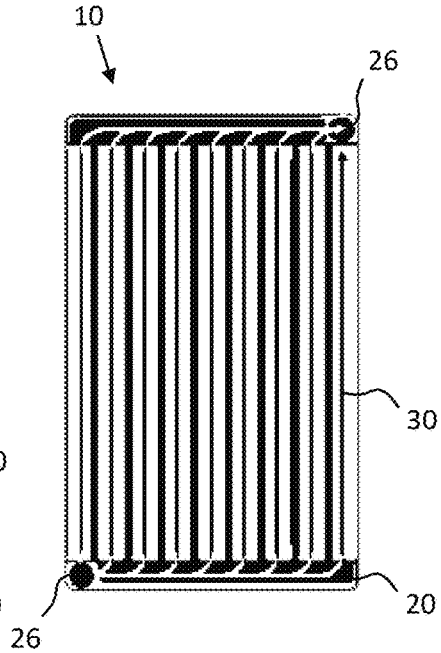
FIG. 3B is a top view of a panel assembly illustrating a parallel flow path of a temperature control material.
Figure 3C:
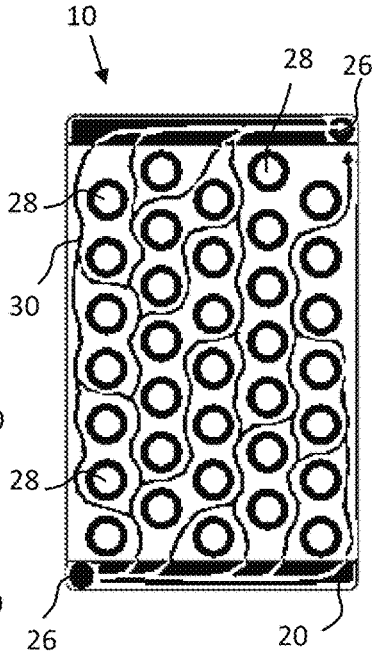
FIG. 3C is a top view of a panel assembly illustrating a random flow path of a temperature control material.

FIG. 3A-3C illustrate top views of a heat exchange assembly 10 with varying temperature control material flow paths. As illustrated, the heat exchange assembly 10 includes opposing reservoirs 20 each having a hole 26. The reservoirs 20 are positioned on opposing sides of the heat exchange assembly 10 so that a temperature control material 30 may flow between the reservoirs 20 and through the heat exchange assembly 10. As shown in FIGS. 1 and 2, the heat exchange assembly 10 may include a core, an adhesive material, or both that creates one or more channels, flow paths, projections 20, or a combination thereof to divert and determine a flow path of the temperature control material. As shown in FIG. 3A, the temperature control material 30 may flow in a substantially looping path through channels of the heat exchange assembly 10. Additionally, as shown in FIG. 3B, the temperature control material 30 may have a plurality of temperature control material paths running substantially parallel to one another through a plurality of channels of the heat exchange assembly 10. Alternatively, or in addition, the temperature control material 30 may have a substantially random flow path around one or more projections of adhesive 28 of the heat exchange assembly 10, as shown in FIG. 3C.

Figure 4:
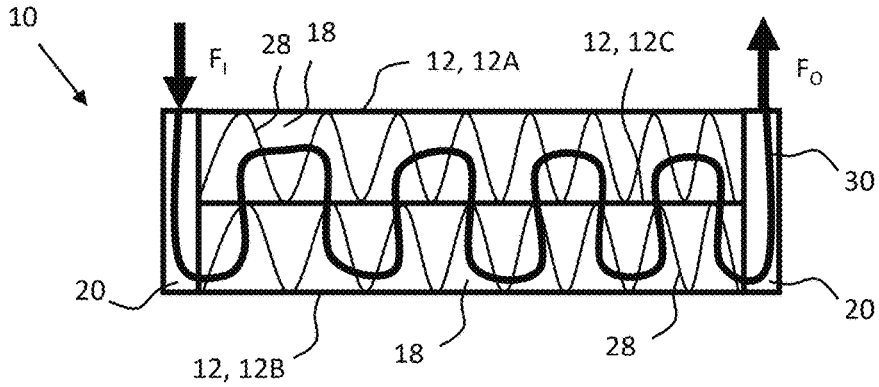
FIG. 4 is a cross-sectional view of a panel assembly illustrating a flow path of a temperature control material.

FIG. 4 illustrates a cross-sectional view of a heat exchange assembly 10. The heat exchange assembly 10 includes a plurality of panels 12 spaced apart by one or more adhesive materials 28. A top panel 12A and an intermediate panel 12C are spaced apart by an adhesive material 28, and similarly, the intermediate panel 12C and a bottom panel 12B are also spaced apart by an adhesive material 28. The adhesive material 28 may form a plurality of channels 18 so that a temperature control material 30 may flow through the channels 18. Additionally, one or more of the panels 12 may be permeable (e.g., the intermediate panel 12C) so that the temperature control material 30 may also flow through the panels 12. The heat exchange assembly 10 may further include opposing reservoirs 20. As illustrated, the temperature control material 30 may flow into a temperature control material inlet ($F_I$), through the heat exchange assembly 10, and out of a temperature control material outlet $F_O$. It should be noted that the temperature control material 30 may be recirculated to continuously flow in a desired path. The temperature control material may be recirculated via one or more pumps, one or more impellers, one or more propellers, or a combination thereof (not shown).

Figure 5:
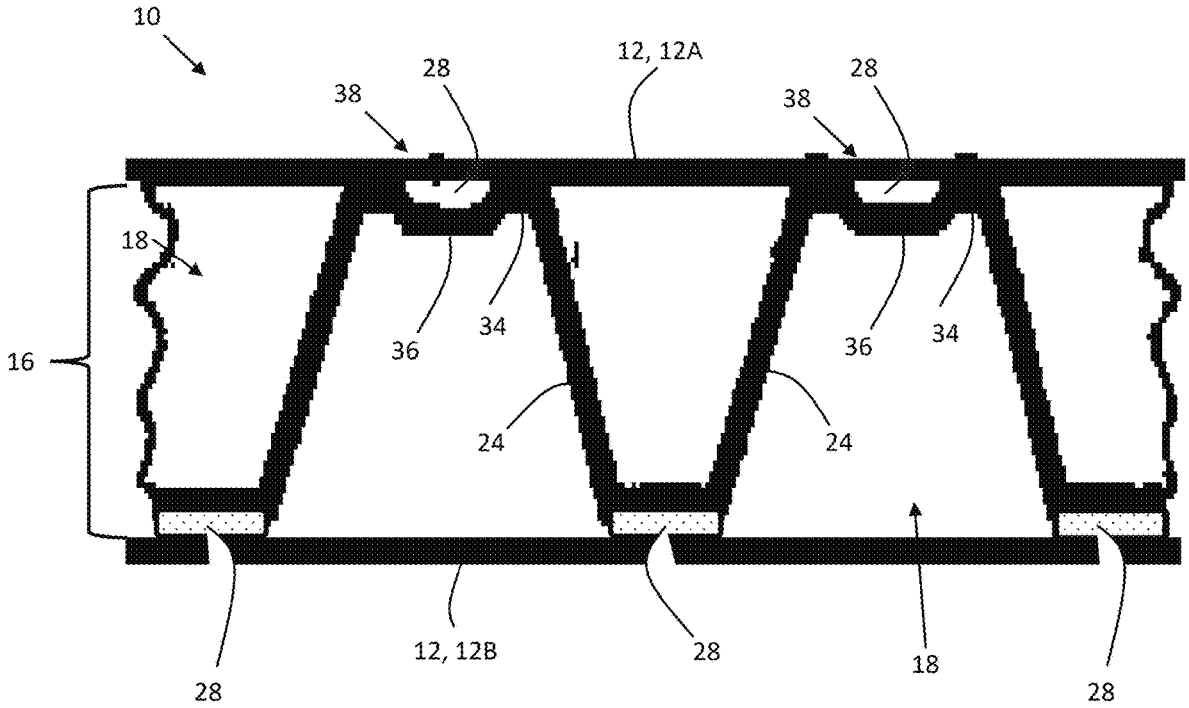
FIG. 5 is a cross-sectional view of a panel assembly.

FIG. 5 illustrates a cross-sectional view of a portion of a heat exchange assembly 10. The heat exchange assembly 10 includes a core 16 sandwiched between opposing panels 12. A top panel 12A and a bottom panel 12B may at least partially secure and/or encase the core 16 to contain a temperature control material flowing through the core (not shown). The core may include a plurality of projections 24 joined by bridges 34 to form a plurality of channels 18 within the core. The channels 18 may form a passageway for the temperature control material (e.g., a coolant material). As such, the channels 18 may be at least partially interconnected to create the passageway (see FIGS. 3A-3C and 4).

To ensure the core 16 is secured within the panels 12, an adhesive material 28 may be disposed along one or more surfaces of the panels 12, the core 16, or both. The adhesive material 28 may be disposed between a bridge 34 of the core 16 and an inner surface of the panels 12 that abuts the bridge 34. Beneficially, the adhesive material 28 may be at least partially or entirely disposed within a valley 36 of the bridge 34. As a result, the adhesive material 28 may be secured within a cavity 38 formed between the valley 36 of the bridge 34 and the panel 12. Therefore, the adhesive material 28 may advantageously secure the panel 12 to the core 16 while being at least partially protected from contact with a temperature control material flowing through the adjacent channels 18. For example, it is envisioned that a thickness of the adhesive material 28 may be partially or fully contained within the valley 36 to mitigate contact between the adhesive material 28 and the temperature control material. That is, a gap between the core 16 and the panels 12 may be minimized to decrease an exposed surface area of the adhesive material 28 for the temperature control material to contact.

ELEMENT LIST

10 Heat Exchange Assembly
12 Panel
12A Top Panel
12B Bottom Panel
12C Intermediate Panel
14 Side Wall
16 Core
18 Channel
20 Reservoir
22 Opening
24 Projection
26 Hole
28 Adhesive Material
30 Temperature Control Material
32 Reinforcing Strut
34 Bridge
36 Valley
38 Cavity
40 Spacer Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

Unless otherwise stated, a teaching with the term "about" or "approximately" in combination with a numerical amount encompasses a teaching of the recited amount, as well as approximations of that recited amount. By way of example, a teaching of "about 100" encompasses a teaching of 100+/−15.

The preferred embodiment of the present invention has been disclosed. A person of ordinary skill in the art would realize however, that certain modifications would come within the teachings of this invention. Therefore, the following claims should be studied to determine the true scope and content of the invention.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled.

The disclosures of all articles and references, including patent applications and publications, are incorporated by reference herein in their entirety for all purposes. Other combinations are also possible as will be gleaned from the following claims, which are also hereby incorporated by reference in their entirety into this written description.

What is claimed is:

1. A heat exchange assembly comprising:

(a) two or more panels, wherein the two or more panels include:

(i) a first metallic panel; and (ii) a second polymeric panel;

(b) a core disposed between the two or more panels, wherein the core includes:

(i) a plurality of projections which extend between the two or more panels, wherein the plurality of projections forms a plurality of channels formed between the two or more panels;

(ii) one or more bridges which interconnect the plurality of projections;

(iii) one or more valleys formed in the one or more bridges; and (iv) an adhesive material, which is foamable, disposed in the one or more valleys which secures the core to the two or more panels, wherein the adhesive material has a thickness substantially equal to a depth of the one or more valleys; and (c) a reservoir located adjacent to the plurality of channels and configured to at least temporarily store a temperature control material;

wherein the plurality of channels are configured to direct a flow path of the temperature control material between the two or more panels; and wherein the plurality of channels provides structural rigidity to the heat exchange assembly;

wherein the two or more panels include a top panel, a bottom panel, and an intermediate panel;

wherein the top panel is the first metallic panel and the bottom panel is the second polymeric panel:

wherein the core is a first core between the top panel and the intermediate panel;

wherein the heat exchange assembly includes a second core between the intermediate panel and the bottom panel, the second core having a plurality of projections, a plurality of channels, one or more bridges, one or more valleys, and an adhesive material configured same as the first core; and wherein the plurality of channels of the first core is disposed between both the top panel and the intermediate panel and the plurality of channels of the second core is disposed between the intermediate panel and the bottom panel.

2. The heat exchange assembly according to claim 1, further comprising a plurality of side walls that abut terminal edges of the two or more panels to form a housing around the plurality of channels.

3. The heat exchange assembly according to claim 1, wherein the reservoir includes an opening that abuts the plurality of channels so that the flow path of the temperature control material moves from the reservoir, through the opening, and into the plurality of channels, or vice versa.

4. The heat exchange assembly according to claim 1, wherein the flow path of the temperature control material loops through the plurality of channels in a snake-like pattern.

5. The heat exchange assembly according to claim 1, wherein the flow path of the temperature control material flows through the plurality of channels in a substantially parallel and simultaneous manner.

6. The heat exchange assembly according to claim 1, wherein the two or more panels include a coating to protect from galvanic or other type of corrosion.

7. The heat exchange assembly according to claim 1, wherein the reservoir includes the temperature control material; and wherein the temperature control material is polyethylene glycol, air, a refrigerant, water, alcohol, a phase change material, or a combination thereof.

8. The heat exchange assembly according to claim 1, wherein the intermediate panel is permeable by including a plurality of holes, gaps, spaces, or a combination thereof.

9. The heat exchange assembly according to claim 8, wherein the plurality of projections and the one or more bridges are a polymeric material.

10. The heat exchange assembly according to claim 1, further comprising a second reservoir; and wherein the reservoir and the second reservoir are positioned on opposing ends of the plurality of channels so that the temperature control material flows between the reservoir and the second reservoir through the plurality of channels.

11. The heat exchange assembly according to claim 1, wherein the one or more valleys form a cavity with the two or more panels; and wherein the adhesive material is at least partially positioned within the cavity after assembly to minimize contact between the adhesive material and the temperature control material.

12. The heat exchange assembly according to claim 1, wherein the heat exchange assembly is included in an automotive battery housing.

13. The heat exchange assembly according to claim 1, wherein the plurality of channels has a height of more than 0.3 mm.

14. The heat exchange assembly according to claim 3, wherein the opening includes one or more reinforcement struts that maintain a structure of the opening.

15. The heat exchange assembly according to claim 1, wherein the heat exchange assembly includes a heating element.

16. The heat exchange assembly according to claim 15, wherein the plurality of channels includes the heating element.

17. The heat exchange assembly according to claim 15, wherein the heating element comprises one or more resistive wires.

18. A heat exchange assembly comprising:

(a) two or more panels including a first panel and a second panel, wherein the first panel is metallic and the second panel is polymeric, and wherein the two or more panels include a coating to protect from galvanic or other type of corrosion;

(b) a core disposed between the two or more panels, wherein the core includes:

i) a plurality of projections which extend between the two or more panels, wherein the plurality of projections forms a plurality of channels formed between the two or more panels;

ii) one or more bridges which interconnect the plurality of projections;

iii) one or more valleys formed in the one or more bridges;

iv) an adhesive material, which is formable disposed in the one or more valleys which secures the core to the two or more panels, wherein the adhesive material has a thickness substantially equal to a depth of the one or more valleys; and (c) a reservoir located adjacent to the plurality of channels and configured to at least temporarily store a temperature control material;

wherein the plurality of channels are configured to direct a flow path of the temperature control material between the two or more panels;

wherein the plurality of channels provides structural rigidity to the heat exchange assembly; and wherein the reservoir includes an opening that abuts the plurality of channels so that the flow path of the temperature control material moves from the reservoir, through the opening, and into the plurality of channels, or vice versa.

19. A heat exchange assembly comprising:

(a) three or more panels including a first panel, an intermediate panel, and a second panel; wherein the first panel is metallic, the second panel is polymeric, and the intermediate panel is permeable; and wherein at least two of the three or more panels include a coating to protect from galvanic or other type of corrosion;

(b) a first core disposed between the first panel and the intermediate panel and a second core disposed between the intermediate panel and the second panel, wherein the first core and the second core are each formed of a polymeric material and each include:

i) a plurality of projections which extend between two of the three or more panels so that the plurality of projections of the first core forms a plurality of channels between the first panel and the intermediate panel and the plurality of projections of the second core forms a plurality of channels between the intermediate panel and the second panel;

ii) one or more bridges which interconnect the plurality of projections;

iii) one or more valleys formed in the one or more bridges;

iv) an adhesive material, which is foamable, disposed in the one or more valleys which secures the first core and the second core to the two of the three or more panels, wherein the adhesive material has a thickness substantially equal to a depth of the one or more valleys; and (c) a reservoir located adjacent to the plurality of channels and configured to at least temporarily store a temperature control material;

wherein the plurality of channels are configured to direct a flow path of the temperature control material between the three or more panels;

wherein the plurality of channels provides structural rigidity to the heat exchange assembly; and wherein the reservoir includes an opening that abuts the plurality of channels so that the flow path of the temperature control material moves from the reservoir, through the opening, and into the plurality of channels, or vice versa.

* * * * *